US005815861A

United States Patent [19]

LaGrange et al.

[11] Patent Number: 5,815,861

[45] Date of Patent: Oct. 6, 1998

[54] SHEET GRIPPING SYSTEM

[76] Inventors: Linda LaGrange, 1010 Simon Angelle Rd., Arnaudville, La. 70512; Gloria Borel, 17306 Wyeth Cir., Spring, Tex. 77379

[21] Appl. No.: 502,962

[22] Filed: Jul. 17, 1995

[51] Int. Cl.[6] ..... A47G 9/04; A47C 21/02

[52] U.S. Cl. ..... 5/504.1; 5/496; 24/72.5

[58] Field of Search ..... 5/504.1, 496, 498, 5/497, 482, 658, 495; 24/72.5

[56] References Cited

U.S. PATENT DOCUMENTS

| | | | |
|---|---|---|---|
| 2,284,778 | 6/1942 | Treiber | 5/498 |
| 3,092,848 | 6/1963 | Gronvold | 5/496 |
| 4,662,016 | 5/1987 | Seeman | 24/72.5 |
| 4,698,880 | 10/1987 | Hamm | 5/498 |
| 4,891,856 | 1/1990 | Thornhill | 5/496 |
| 4,937,904 | 7/1990 | Ross | 5/497 |
| 5,179,743 | 1/1993 | Lanman | 5/498 |
| 5,263,212 | 11/1993 | Garcia | 5/496 |

*Primary Examiner*—Alexander Grosz
*Attorney, Agent, or Firm*—Joseph T. Regard, Ltd.

[57] ABSTRACT

A system for retaining a fitted or flat sheet to a mattress utilizing first and second, generally "T" configured straps having first, second, and third gripping ends configured to engage the ends and lower sheet situated about and directly engaging the mattress, the system contemplating the straps being juxtaposed the box spring and mattress, retaining the lower sheet firmly in place. The present system is particularly suitable for holding the lower sheet in place where the sheet might otherwise become dislodged, such as, for example, utilization in conjunction with bedding utilized by bed ridden persons, invalids, and children.

7 Claims, 1 Drawing Sheet

SHEET GRIPPING SYSTEM

TECHNICAL FIELD of the INVENTION

This invention relates to bedding accessories, and in particular to a system for retaining a fitted or flat sheet to a mattress utilizing first and second, generally "T" configured straps having first, second, and third gripping ends configured to engage the ends and lower sheet situated about and directly engaging the mattress, the system contemplating the straps being juxtaposed the box spring and mattress, retaining the lower sheet firmly in place.

The present system is particularly suitable for holding the lower sheet in place where the sheet might otherwise become dislodged, such as, for example, utilization in conjunction with bedding utilized by bed ridden persons, invalids, and children.

BACKGROUND OF THE INVENTION

While the prior art has contemplated a variety of diverse systems for retaining sheets and other bedding in place, it is believed that none particularly contemplate or suggest the present invention.

As will be shown in the discussion of prior patents infra, the prior art has failed to contemplate a particularly effective, yet inexpensive and easy to implement, system for retaining bed sheets in place about a mattress.

A listing of prior patents which are deemed to be at least of general pertinence to the present invention is set forth below:

| Patent Number | Inventor | Date of Issue |
|---|---|---|
| 4,891,856 | Thornhill | 01/09/1990 |
| 4,698,880 | Hamm | 10/13/1987 |
| 4,662,016 | Seeman | 05/05/1987 |
| 3,092,848 | Gronvold | 06/11/1963 |
| 2,284,778 | Treiber | 06/02/1941 |

U.S. Pat. No. 4,891,856, issued 1990 teaches a "Grasping System for Use with a Contoured Sheet", contemplating a strap configuration having a strap system situated between the box spring and mattress, configured to communicate with the sheet in such a fashion as to retain it tucked about the mattress. The system is adjustable, and contemplates clasps for clasping the sheets. However, this contemplates an "X" configuration strap system comprising two straps forming a unitary, single piece, as opposed to the two piece, "T" system of the present invention.

It is asserted that the single, unitary system of the U.S. Pat. No. '856 would be more difficult to install than the present invention, as it appears to require lifting of the entire mattress lower side, as opposed the present invention, which only requires lifting of each end of the mattress for installation.

U.S. Pat. No. 4,698,880 contemplates a sheet retention "Device for Retarding the Position of Bedclothing", teaching a multitude of longitudinal and transversely situated straps for engaging the lower sheet about the lower face of the mattress, the straps affixed to one another to form a one piece strapping system.

U.S. Pat. No. 4,662,016 teaches an elastic, adjustable strap system configured to retain the upper sheet or blanket under the bed, and is otherwise distinguishable from the present invention.

U.S. Pat. No. 2,284,778 apparently contemplates a plurality of longitudinal fabric strips, and a plurality of transverse strips configured to engage the longitudinal strips to form a grid, for retaining the sides and ends of the lower sheet tucked between the box spring and mattress, much like the U.S. Pat. No. '880.

Thus, while the above patent contemplate various and diverse strap systems for engaging and retaining a lower bed sheet about a mattress, these systems are distinguishable both in form and function from the present invention.

SUMMARY DISCUSSION OF THE INVENTION

The present invention contemplates a two piece, generally "T" configured strap system for retaining a lower sheet about a mattress which is easily implemented, relatively inexpensive, and highly effective.

Unlike the prior art, the present invention system can be easily and quickly implemented without the necessity of lifting the entire mattress all at once, instead requiring the relatively easy lifting of each end of the mattress, one at a time.

The preferred embodiment of the present invention contemplates a strap system comprising first and second, generally "T" configured straps, wherein each strap has a central, generally longitudinally situated end strap having a first end affixed to the medial area of a lateral strap having first and second ends with clasps thereon for grasping respective sides of a sheet folded about a mattress, said central strap having a second end having a clasp for grasping and frictionally retaining an end of the sheet folded about the end of the mattress.

In use, one would remove the sheets from the bed, replacing the lower sheet with a clean ones tucking said sheet in place, then lifting the first end of the mattress, affixing the central, longitudinal strap to generally the medial area of the end of the sheet corresponding with the lifted end of the mattress, then affix the respective ends of the lateral strap to the respective first and second edges of the sheet corresponding with the edges of the mattress. The operation is then repeated with a second strap system at the second end of the mattress, then the top bed sheet, blankets, comforter, et al are installed, and the operation is complete.

Although the prior art suggested sheet anchoring systems utilizing both lateral and horizontal straps, none particularly teach or contemplate the configuration of the present invention, which has been found to be particularly suitable in use, as well as being economical and easily implemented and installed.

It is therefore an objective of the present invention to provide a system for grasping and retaining a lower sheet about a mattress.

It is another objective of the present invention to provide a system for grasping and retaining a lower sheet about a mattress, which is easily implemented, and does not require the lifting of the complete mattress for installation or changing of sheets.

It is still another objective of the present invention to provide a system for grasping and retaining a lower sheet about a mattress which utilizes two strap systems communicating with opposing ends and sides of the sheet wrapped about the mattress.

Lastly, it is an objective of the present invention to provide a system for grasping and retaining a lower sheet about a mattress which is effective and inexpensive to manufacture.

BRIEF DESCRIPTION OF DRAWINGS

For a further understanding of the nature and objects of the present invention, reference should be had to the following detailed description, taken in conjunction with the accompanying drawings, in which like parts are given like reference numerals, and wherein.

DETAILED DISCUSSION OF THE INVENTION

Figure 1:
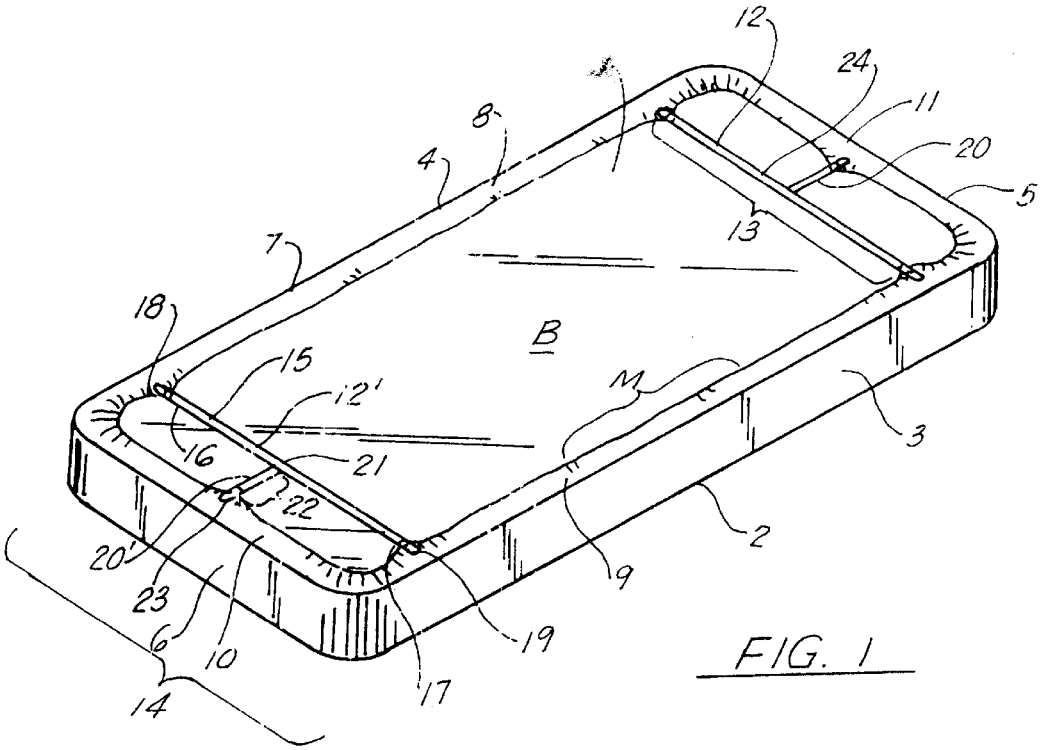
FIG. 1 is a lower, isometric view of the sheet gripping and retaining system of the present invention, illustrating the lower face of the mattress, showing the placement and configuration of the first and second strap systems about the first and second ends of the sheet, respectively.

Referring to FIG. 1, the preferred, exemplary embodiment of the sheet gripping system of the present invention is configured to be utilized in conjunction with a mattress B having an underside 1 and a top side 2, first 3 and second 4 edges, and first 5 and second 6 ends.

As shown, and as typically configured, the mattress has a sheet 7 wrapped about and thereby enveloping the top 2 side, the edges, and the ends of the mattress B, with portions of the sheet contacting the underside I of said mattress, particularly, tucked about and under 9, 8 the first and second edges, respectively, as well as tucked about and under 11, 10 the first and second ends, respectively, of the mattress. While the present figures illustrate as an example the utilization of a fitted sheet, a flat, non-fitted sheet would be similarly positioned when a bed is made, such that the tucked portions fall between the underside of the mattress and the box springs, so that the sheet remains in place on the bed.

Continuing with FIG. 1, the sheet gripping system of the present invention comprises two separate, independent gripping pieces 12, 15, each configured for engaging and gripping opposing ends 11, 10 of the tucked sheet, respectively. Each of the gripping pieces 12, 15 comprises a lateral strap member 24 which is laterally situated relative to the longitudinal axis of the bed, the lateral strap member 24 having generally about the same length 13 as the width 14 of the mattress B.

Each lateral strap member has first 16 and second 17 ends, with a medial area 21 therebetween, the first and second ends having first 18 and second 19 clasp members, respectively, said clasp members configured to grip the portions of the sheet tucked about and under 8, 9 the second and first edges of the mattress, respectively, past the corner area of the mattress, but before the medial edge area M of said mattress.

Emanating from the medial area 21 of the lateral straps 12, 12' are longitudinal straps 20, 20', respectfully, said straps 20, 20' each having a clasp member 23 at its end distal the end joining the medial portion of the lateral strap. Said longitudinal straps are generally aligned with the longitudinal axis of the mattress, with each of the straps 20, 20' configured to have a length 22 adequate to enable the engagement and gripping, via their respective clasp members, of the portions of the sheet tucked about and under the first 11 and second 10 ends of the mattress B, respectively. In any case, the length 22 of the longitudinal strap members is generally shorter than that of the lateral strap members 20, 20'.

Figure 2:
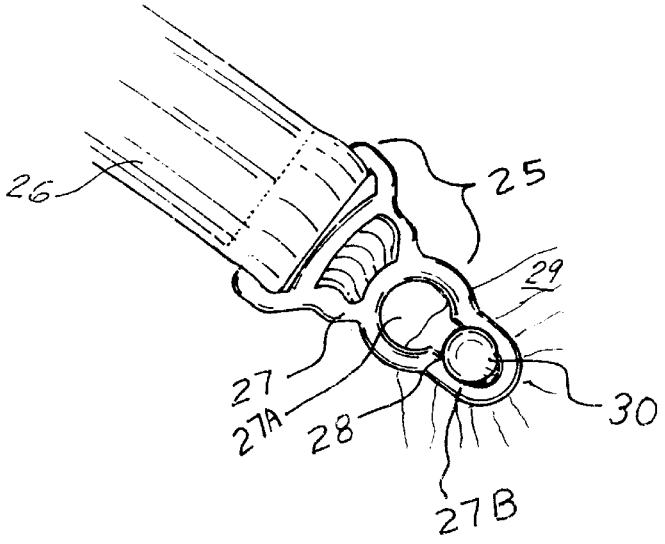
FIG. 2 is an upper, close-up view of the sheet gripping and retaining system of FIG. 1, illustrating a close up of the clasp forming the ends of the strap system, engaging the sheet.

FIG. 2 illustrates the preferred embodiment of the exemplary clasp member 25 taught for utilization in conjunction with the engaging ends of both the lateral and longitudinal straps, those clasping members earlier referred to in FIG. 1 as 18, 19, and 23.

Returning to FIG. 2, the clasp member 25 engages the end of the strap to which it is affixed, and may include an adjustment loop 26 to vary the length or tightness of the strap, a clasp 27 having a gripper portion 28, which cooperates with an insert 30 which is placed into the wide portion 27A of the clasp area with the sheet 29 juxtaposed therebetween, the insert then slided into the clasp narrow area 27B, thereby frictionally engaging the sheet.

Returning to FIG. 1, in use, the user tucks the first sheet about and under the mattress as usual, such that portions of the sheet are sandwiched under the mattress, between said mattress and the box springs.

Next the user takes the first gripping piece 12, and lifting the first end 5 of the mattress forming the bed, engages the clamping members at opposing ends of the lateral straps to the opposing portions of the sheets tucked under the edges of the mattress, between the corner and medial area of the mattress, near the first end of the mattress. Next, the user draws the longitudinal strap towards the first end of the bed, engaging the clamping member at the end of the longitudinal strap to that portion of the sheet tucked under the first end of the mattress. The user may then adjust the adjustment loops at the respective ends of the straps to tighten them in place. The operation is then repeated, but at the second end 6 of the mattress, and utilizing the second gripping piece 12'.

It is also noted that the present invention may be utilized to anchor both the lower sheet, whether fitted or flat, as well as the lower, tucked in portion of the upper sheet, if desired, by the user merely clamping that portion of the tucked in sheet corresponding near the respectively positioned gripping piece, in which case the gripping members of said gripping piece would engage, if desired, both the lower sheet and top sheet.

It is noted that the straps forming the first and second gripping pieces may be made of elastic or non-elastic material. Further, it is noted that the present invention appears to work equally well in twin, double, queen, king, and other side mattresses.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A sheet gripping system for use with a mattress having four corners, forming first and second edges and first and second ends, said sheet gripping system configured to anchor and retain in place a sheet wrapped about and tucked under said first and second ends, and first and second edges, of said mattress, said mattress further having a longitudinal axis and a medial edge area, said sheet gripping system comprising:

first and second, independent gripping pieces, each of said gripping pieces comprising a lateral strap having first and second ends, first and second edges, and a medial area therebetween, said first and second ends of said lateral strap having lateral gripper members situated thereon, said lateral strap further having emanating from one of said edges, in said medial area, a generally perpendicularly situated longitudinal strap of lesser length than said lateral strap, said longitudinal strap having a distal end distal from said end joining said lateral strap, said distal end having thereon a longitudinal gripper member;

said longitudinal gripper member of said first independent gripping piece configured to grip that portion of said sheet wrapped about and tucked under said first end of said mattress, said lateral gripper members of said first and second ends of said lateral strap of said first independent gripping piece configured to grip that portion of said sheet wrapped about and tucked under said first and second edges of said mattress, respectively;

said longitudinal gripper member of said second independent gripping piece configured to grip that portion of said sheet wrapped about and tucked under said second end of said mattress, said lateral gripper members of said first and second ends of said lateral strap of said second independent gripping piece configured to grip that portion of said sheet wrapped about and tucked under said first and second edges of said mattress, respectively said gripper members further comprising an adjustment loop to vary the lenghth or tightness of the straps to which they are attached, the longitudinal straps of the gripping pieces, when installed on a mattress, being generally aligned with the longitudinal axis of the mattress.

2. The sheet gripping system of claim 1, wherein said longitudinal strap of said gripping pieces, when installed on said mattress, is aligned with the longitudinal axis of said mattress, and said lateral strap of said gripping pieces, when installed, is laterally situated relative to said longitudinal axis of said mattress.

3. The sheet gripping system of claim 1, wherein said gripper members further comprise clasps having a gripping portion.

4. The sheet gripping system of claim 3, wherein said gripping members have a clasp comprising a gripper portion having wide and narrow portions, and an insert, said insert placed into said wide portion of said gripper area with said sheet juxtaposed therebetween, said insert then slid into said narrow gripper portion, thereby frictionally engaging the sheet.

5. The method of anchoring a sheet wrapped about and tucked under a mattress having first and second sets of corners, forming first and second edges and first and second ends, said mattress further having a longitudinal axis and a medial edge area, comprising the steps of:

a. providing first and second, independent gripping pieces, each of said gripping pieces comprising a lateral strap having first and second ends, first and second edges, and a medial area therebetween, said first and second ends of said lateral strap having lateral gripper members with an adjustment loop situated thereon, said lateral strap further having emanating from one of said edges, in said medial area, a generally perpendicularly situated longitudinal strap of lesser length than said lateral strap, said longitudinal strap having a distal end distal from said end joining said lateral strap, said distal end having thereon a longitudinal gripper member with an adjustment loop.

b. lifting said first end of said mattress, while utilizing said longitudinal gripper member of said first independent gripping piece to grip that portion of said sheet wrapped about and tucked under said first end of said mattress, and utilizing said lateral gripper members of said first and second ends of said lateral strap of said first independent gripping piece to grip that portion of said sheet wrapped about and tucked under said first and second edges of said mattress, respectively;

c. lifting said second end of said mattress, while utilizing said longitudinal gripper member of said second independent gripping piece to grip that portion of said sheet wrapped about and tucked under said second end of said mattress, and utilizing said lateral gripper members of said first and second ends of said lateral strap of said second independent gripping piece to grip that portion of said sheet wrapped about and tucked under said first and second edges of said mattress, respectively, the longitudinal straps of the gripping pieces being generally aligned with the longitudinal axis of the mattress.

6. The method of claim 5, wherein said lateral gripper members of said first gripping piece contact said sheet between one of said corners adjacent to said first end of said mattress, and said medial edge area of said mattress.

7. The method of claim 6, wherein said lateral gripper members of said second gripping piece contact said sheet between one of said corners adjacent to said second end of said mattress, and said medial edge area of said mattress.

* * * * *